United States Patent [19]

Scheurer et al.

[11] Patent Number: 4,673,365

[45] Date of Patent: Jun. 16, 1987

[54] WATER SKI BINDER

[75] Inventors: Robert S. Scheurer, P.O. Box 539, Wichita Falls, Tex. 76307; Kendal Hancock, Wichita Falls, Tex.

[73] Assignee: Robert S. Scheurer, Wichita Falls, Tex.

[21] Appl. No.: 729,127

[22] Filed: May 1, 1985

[51] Int. Cl.[4] ..... B63H 5/16

[52] U.S. Cl. ..... 441/70; 280/634

[58] Field of Search ..... 441/70; 280/623, 633, 280/618, 632, 634, 611–617, 619–622, 624–631, 635–637

[56] References Cited

U.S. PATENT DOCUMENTS

| | | | |
|---|---|---|---|
| 2,540,576 | 2/1951 | Goodhue et al. | 441/70 |
| 3,118,157 | 1/1964 | Houser | 441/70 |
| 3,798,691 | 3/1974 | Notermann et al. | 441/70 |
| 3,950,001 | 4/1976 | Weigl | 280/618 |
| 4,302,027 | 11/1981 | Himmetsberger et al. | 280/633 |

*Primary Examiner*—Joseph F. Peters, Jr.
*Assistant Examiner*—Jesûs D. Sotelo
*Attorney, Agent, or Firm*—James C. Wray

[57] ABSTRACT

A slidable toe piece has rearward extensions which are cam locked in place in tunnels in the fixed heel piece.

15 Claims, 11 Drawing Figures

FIG. 9
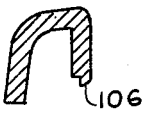
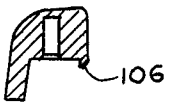
FIG. 10
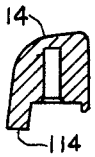
FIG. 11
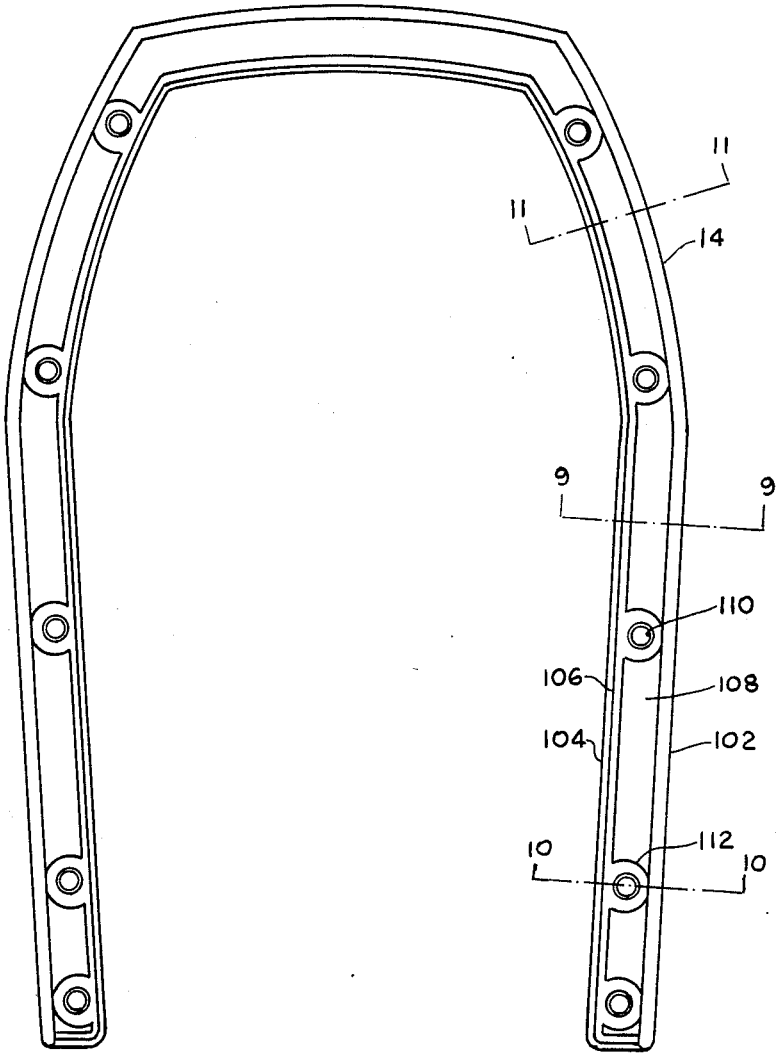
FIG. 7
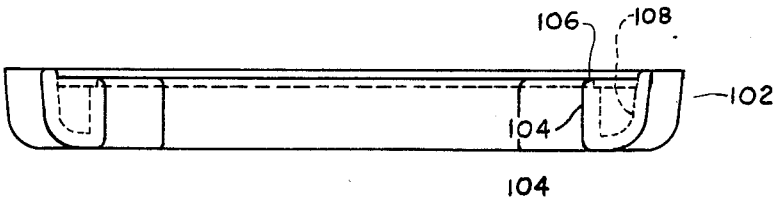
FIG. 8

WATER SKI BINDER

BACKGROUND OF THE DISCLOSURE

Many water ski foot binders have adjustable heel pieces. That creates two problems.

In water skiing, as in other forms of skiing, it is important to precisely position the center of gravity of the user. Slidably adjusting the heel piece to change the size of the binding axially moves the center of gravity, resulting in changed ski performance. In slalom ski bindings, it is important to place the trailing toe piece as close as possible to the leading heel piece. When the leading heel piece is slid forward to adjust the size of the front foot binder, the heel piece moves away from the rear toe piece, changing operational characteristics of the ski.

The present invention is designed to overcome problems inherent the prior art and to provide a quickly and conveniently adjustable ski.

SUMMARY OF THE INVENTION

The present invention provides a rapidly and easily adjustable toe piece to quickly adjust and clamp the toe piece in position and to maintain the heel piece and center of gravity of the occupant in fixed position. The center of gravity or better the center of force applied on the ski by the occupant may be considered to be the center of the occupant's ankle bone. When attaching a ski to the foot, one easily slides one part of the binder open before inserting the foot and slides the binder part closed to capture the foot. When persons with different size feet use the same binders, centers of force are shifted longitudinally on the ski. When a single person uses a ski and when the bindings are adjusted for that one person, the center of gravity may be shifted slightly and adversely by changes in binding adjustment. Additionally, the rear toe in a slalom mount will be positioned too far behind the heel which slides along the ski.

The present invention provides easy fastening of the binding in its closed position by simply pushing down on two cams and easy release by simply pulling up on the two cams.

In a preferred embodiment, an adjustable toe binder apparatus comprises a flexible instep and toe cover having peripheral edges, grip means for gripping the peripheral edges and slide means for supporting the grip means and peripheral edges. Guiding means are mounted on the slide means for guiding the slide forward and rearward. First locking means mounted on the slide and second locking means connected to a fixed heel support cooperate with the first locking means to selectively permit and prevent movement of the slide.

Preferably, the first and second locking means comprise extension means and receiver means.

In a preferred embodiment the extension means is on the slide for extending into the receiver means, which is mounted on the heel piece.

The preferred extension means comprise upward facing detents, and the receiver means comprise pins extending transversely with respect to the binder and cam means mounted on the pins and lever means connected to the cam means for selectively rotating the cam means in one direction or the other around the pin means and urging the cam means into locking contact with the detents.

Preferably the extension means and detent means are mounted on the slide means and extend rearwardly therefrom. The second locking means is on the receiver means and the tunnel means which is mounted on the heel binder support. An opening extends longitudinally through the tunnel means and opens forwardly for receiving the extension means and detent means in sliding relationship.

Preferably the slide means and grip means are U-shaped. The guide means extend laterally from the slide means. Elongated openings receive fasteners fixed in an underlying water ski.

A preferred heel binder means comprises a generally forward opening flexible binder portion with peripheral edges, and a generally forward opening U-shaped plate overlying peripheral edges of the binder portion. Fastener means extend through the plate and the peripheral edges for securing the plate and the binder portion to the ski. The second locking, receiver and tunnel means are spaced laterally on forward portions of the U-shaped heel plate.

A preferred foot binder apparatus for water skis comprises a flexible end-opening cover having a generally U-shaped base with an outwardly extending peripheral flange portions. A generally U-shaped face place has an inner portion configured for overlying the outward extending flange portion of the flexible cover and trapping the flange portion between the water ski and the inner portion of the plate. Fastener means extend through the inner portion of the plate and the laterally extending flange portion and secure the cover and the plate to the water ski in fixed position.

A flexible second cover has an opposite opening and has a peripheral outwardly extending flange on a lower edge thereof. A generally U-shaped second plate has an inner portion for receiving the peripheral flange of the second cover and a generally U-shaped cap means for overlying the second cover flange and fastener means extending through the cover flange for holding the cover flange, cap means and plate assembled. Guide means connected to the second plate and extending longitudinally with respect to the ski permit longitudinal sliding of the second plate with respect to the ski. Guides connected to the ski and to the guide means prevent movement of the second plate away from the ski while permitting movement of the second plate along the ski. First and second adjustable locking means respectively connected to the second plate and to the first mentioned plate lock the second plate in a preselected position with respect to the first plate.

Preferably, the first and second locking means comprise extensions, receivers and cams for locking the extensions in the receivers. The preferred first locking means comprise rearward extensions at opposite rearward ends of the rearward opening U-shaped second plate, and the second locking means comprise forward opening tunnel shaped receivers in opposite ends of the forward opening U-shaped first plate.

Preferably, pins positioned in the first plate and extending transversely with respect to the ski are positioned above the tunnel shaped openings. Cams are mounted on the pins. Levers connected to the cams move the cams selectively forward and away from the extensions in the tunnel shaped receivers to lock the extensions in place or release the extensions.

Preferred extensions have upward facing detents for receiving the cams in selected positions.

A preferred method of adjusting a water ski binding comprises sliding a toe portion rearward and moving rearward extensions on the toe portions into complementary tunnels in the heel portions and moving cams on the heel portions into upwardly facing detents on the rearward extensions to lock the toe portions in place.

The above and further and other objects and features of the invention are apparent in the disclosure which includes the above and ongoing specification with the claims and the drawings.

BRIEF DESCRIPTION OF THE DRAWINGS

FIG. 7 is a bottom view of the toe cap piece for clamping the flexible toe and instep cover to the toe plate.

FIG. 8 is an end elevation of the toe plate and clamp shown in FIGS. 5, 6 and 7.

FIGS. 9, 10 and 11 are details taken along lines 9—9, 10—10 and 11—11 of the upper clamping member shown in FIG. 7.

DETAILED DESCRIPTION OF THE DRAWINGS

Figure 1:
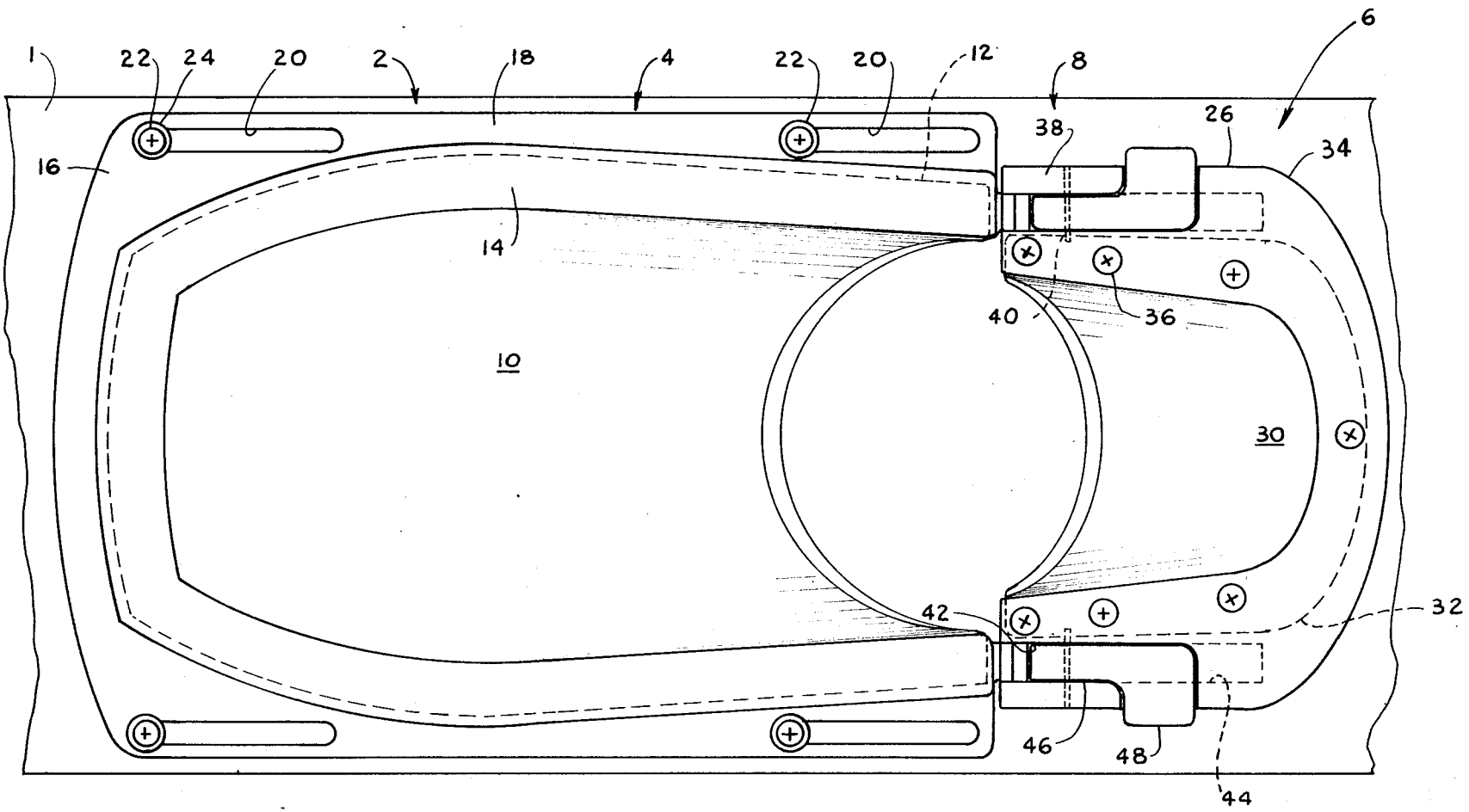
FIG. 1 is a plan view of the foot binder with the adjustable toe piece of the present invention.

In the preferred form of the invention as shown in the drawings, a ski is generally indicated by the numeral 1. A binder generally indicated by the numeral 2 has a toe portion 4 and a heel portion 6. The two portions are joined by locking means generally indicated by the numeral 8. The toe portion 4 has a toe retainer generally indicated by the numeral 10 which covers the toe and instep of the foot of a user. A peripheral outward extending flange 12 of the toe cover 10 is held tightly on the toe piece 4 by fasteners which extend into a generally U-shaped rearward opening cap clamp member 14 and similar U-shaped toe plate 16. Lateral portions 18 of toe plate 16 which extend outward from cap 14 have longitudinally extended openings 20 which slide along non-threaded outer portions of screws 22 which are anchored in the ski 1. Enlarged heads or washers 24 ride atop the lateral areas 18 of the toe plate 16, holding the toe plate firmly against the ski while permitting it to slide for adjustment.

A forward opening, flexible, heel retainer 30 has an outward extending flange portion 32, which extends beneath the heel plate 34. Fasteners 36 pass through the peripheral flange 32 and clamp the flange 32 to the ski 1. The heel plates have lateral extensions 38 which mount the locking means 8. Pins 40 extend through the openings 42 which extend upward from longitudinally extending tunnels 44 in the heel pieces 6. Eccentric cams 46 with operating levers 48 are mounted on the pins 40 as over-the-center clamps to clamp rearward extensions to the toe piece within the tunnels 44 to fix the toe piece in place on the ski.

Figure 2:
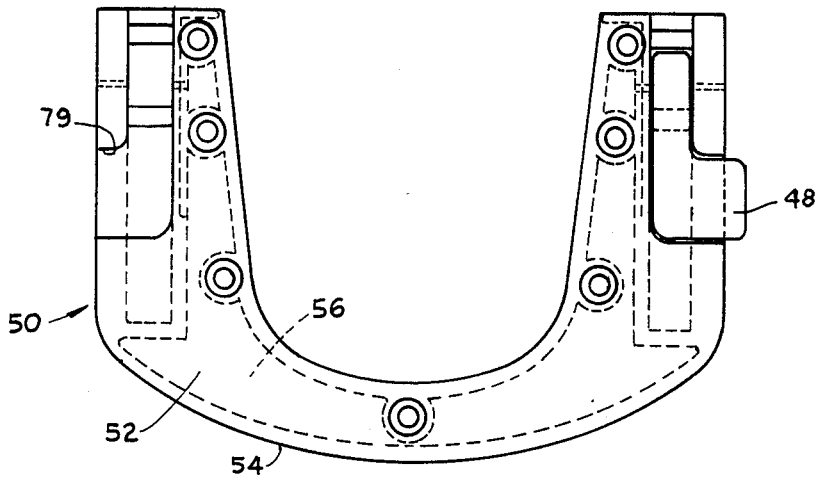
FIG. 2 is a plan view of the heel plate.

A top plan view of a preferred modified heel plate 50 is shown in FIG. 2. Heel plate 50 is a hollow molded piece with a generally rounded upper surface 52 and an outer wall 54 surrounding an internal hollow space 56 as can be seen with reference to the bottom view shown in FIG. 4. Inner wall 58 has a lip 60 which slightly compresses flange 32 to trap the flange between the ski 1 and the plate 50. Countersunk holes 62 are provided to receive screws which extend through the flange 32 into the ski. As shown, the screw holes 62 are formed in inward cylindrical extensions 64 of the inner wall 58. Opening 66 extends upward from a tunnel 70, and a hole 68 communicating with the opening 66 receives a pin 40 as shown in FIG. 1 for mounting the cam 46.

Figure 3:
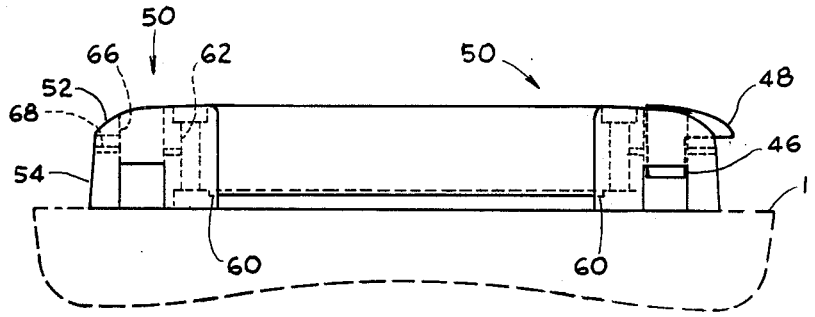
FIG. 3 is an end elevation of the heel plate shown in FIG. 2, showing the mountings of the heel rubber and cam.
Figure 4:
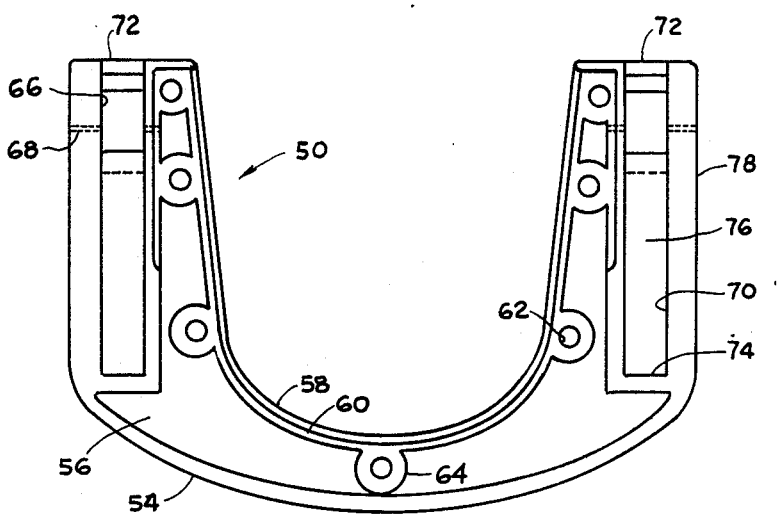
FIG. 4 is a bottom view of the preferred heel plate shown in FIGS. 2 and 3.

Tunnels 70 as showns in FIGS. 2, 3 and 4 differ slightly from the tunnels 44 shown in FIG. 1. While the forward ends 72 of the tunnels are open, the rearward ends are closed. The relatively thick section of the top 76 of the tunnel and the outerwall 78 of the tunnel 70 supports the locking means without requiring the outer screw.

As shown in FIGS. 2 and 3 in one preferred embodiment, the cam lever 48 is positioned within recess 79 so that the upper surface of the cam lever is flush with the top of the heel plate and so that the outer end of the cam lever 48 may extend beyond the heel plate for ease in release.

Figure 6:
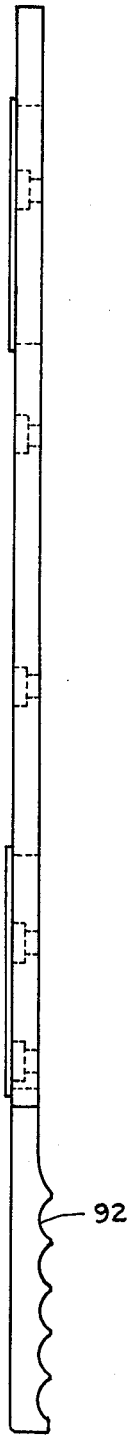
FIG. 6 is a side elevation of the toe plate shown in FIG. 5.
Figure 5:
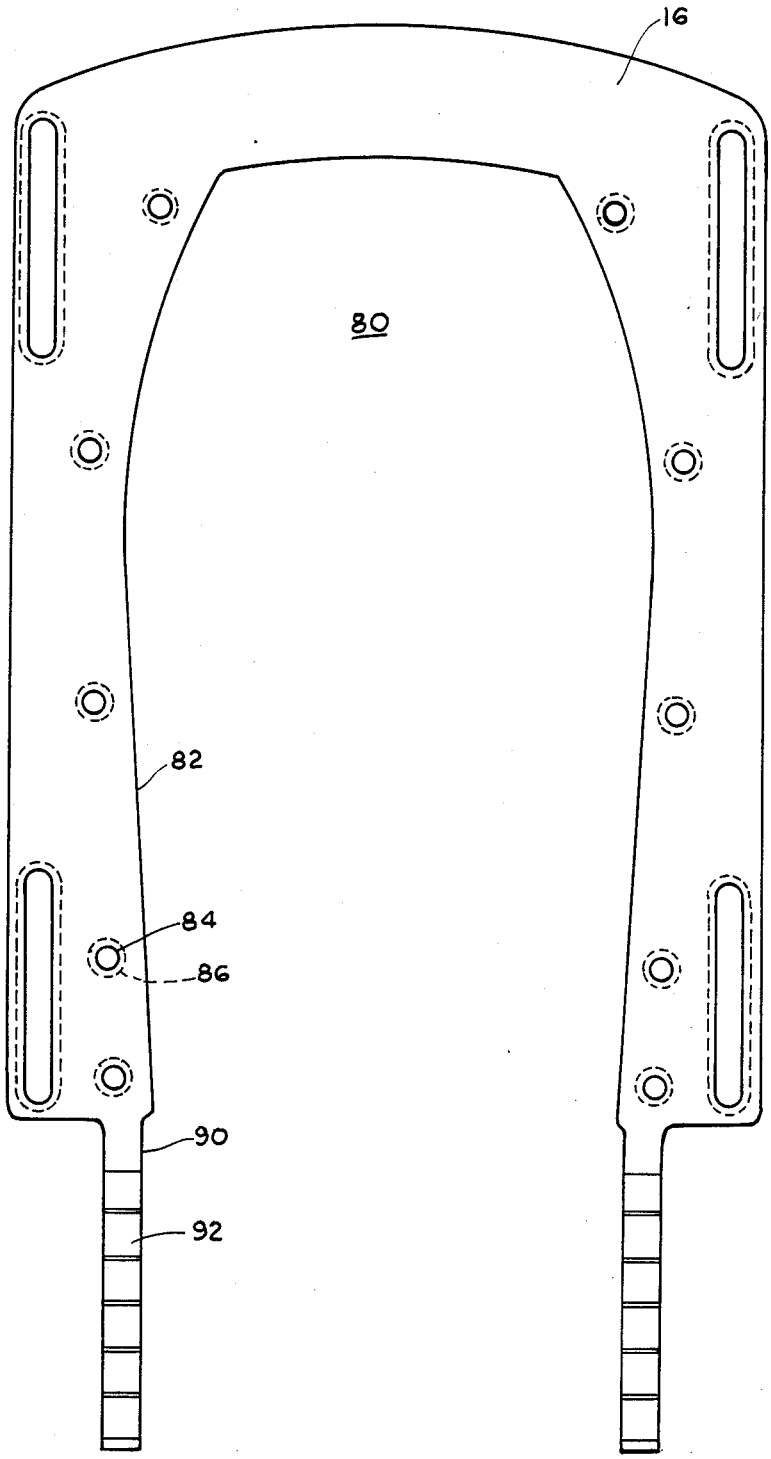
FIG. 5 is a top plan view of the preferred toe plate of the present invention.

As shown in FIGS. 5 and 6, the preferred toe plate has an open center 80 so that the foot of a user may rest directly upon the ski 1. Alternatively, the toe plate may extend across the surface of the ski beneath the foot of the user.

The inner edge 82 of the toe plate is curved inwardly and rearwardly to create the desired shape of the flexible boot and to bring the arch portion inward for foot support. Holes 84 are countersunk 86 from the bottom of the plate to receive the heads of fasteners which extend upward through the flange of the flexible toe cover and into the cap piece where they are secured. The rearward extensions 90 have detents 92 in their upper surfaces to receive the eccentric cams which are mounted in the heel piece.

As shown in FIG. 7, the preferred cap 14 has an outer wall 102 which extends downward to the upper surface of the plate 16. An inner wall 104 has a lip 106 which compresses the flange 12 of the toe cover to hold the flange tightly against the plate 16. An area 108 between the walls 102 and 104 is recessed to provide weight reduction. Holes 110 in cylindrical portions 112 receive fasteners which extend through the peripheral flanges of the toe cover. The holes may be threaded to receive the fasteners or self threading fasteners may cut threads in the material around the holes. The holes may be countersunk to aid in the centering of the screws.

As shown in FIGS. 9, 10 and 11, the distance between the bottom of the cylindrical portions 112 and the lip 106 and the base 114 of the cap 14 may vary to take into account the thicker cross section of the toe cover near the stress receiving instep portion.

While the invention has been described with reference to specific embodiments, modifications and variations may be constructed without departing from the scope of the invention which is defined in the following claims.

What is claimed is:

1. Adjustable toe binder apparatus comprising:

a flexible instep and toe cover having peripheral edges, grip means for gripping the peripheral edges and slide means for supporting the grip means and peripheral edges for movement with the slide means, guiding means mounted on the slide means for guiding the slide means forward and rearward, first locking means mounted on the slide means and second locking means connected to a fixed heel support for cooperating with the first locking means to selectively permit and prevent movement of the slide means.

2. The apparatus of claim 1 wherein the first and second locking means comprise extension means and receiver means.

3. The apparatus of claim 2 wherein the extension means is on the slide means for extending into the receiver means, which is mounted on the heel support.

4. The apparatus of claim 3 wherein the extension means comprises upward facing detents and wherein the receiver means comprises pin means extending transversely with respect to the binder and cam means mounted on the pin means and lever means connected to the cam means for selectively rotating the cam means in one direction or the other around the pin means and urging the cam means into locking contact with the extension means.

5. The apparatus of claim 4 wherein the extension means and detent means are mounted on the slide means and extend rearwardly therefrom and wherein the second locking means is the receiver means and tunnel means which is mounted on the heel support and has an opening which extends longitudinally through the tunnel means and opens forwardly for receiving the extension means and detent means in sliding relationship.

6. The apparatus of claim 5 wherein the slide means and grip means are U-shaped and wherein the guide means extend laterally from the slide means and has elongated openings for receiving fasteners fixed in an underlying water ski and wherein the extension means extend rearward from opposite rearward extensions of the slide means.

7. The apparatus of claim 6 wherein the heel support comprises a generally forward opening flexible binder portion with peripheral edges, and a generally forward opening U-shaped plate overlying peripheral edges of the binder portion and fastener means extending through the plate and the peripheral edges for securing the plate and the binder portion to the ski and wherein the second locking means, namely the receiver and tunnel means are spaced laterally on forward portions of the U-shaped plate.

8. Foot binder apparatus for water skis comprising:

a flexible end opening cover having a generally U-shaped base with laterally outwardly extending peripheral flange portions, a generally U-shaped face plate having an inner portion configured for overlying an outward extending flange portion of the flexible cover and trapping the flange portion between the water ski and the inner portion of the plate and fastener means extending through the inner portion of the plate and the laterally extending flange portions for securing the cover and the plate to the water ski in fixed position, a flexible second cover having an opposite opening and having a peripheral outwardly extending flange on a lower edge thereof, a generally U-shaped second plate having an inner portion for receiving the peripheral flange of the second cover and a generally U-shaped cap means for overlying the second cover flange and fastener means extending through the cover flange for holding the cover flange, cap means and plate assembled, guide means connected to the second plate and extending longitudinally with respect to the ski for permitting longitudinal sliding of the second plate with respect to the ski and guides connected to the ski and to the guide means for preventing movement of the second plate away from the ski while permitting movement of the second plate along the ski and first and second adjustable locking means respectively connected to the second plate and to the first mentioned plate for locking the second plate in a preselected position with respect to the first plate.

9. The apparatus of claim 8 wherein the first and second locking means comprise extensions, receivers and cams for locking the extensions in the receivers.

10. The apparatus of claim 8 wherein the first locking means comprise extensions at opposite sides of the U-shaped second plate, and the second locking means comprise receivers in opposite ends of the U-shaped first plate.

11. The apparatus of claim 10 wherein the receivers are tunnel shaped.

12. The apparatus of claim 11 wherein the second locking means further comprises, pins positioned in the first plate and extending transversely with respect to the ski and positioned above the tunnel shaped receivers, cam mounted on the pins, and levers connected to the cams to move the cams selectively toward and away from the extensions in the tunnel shaped receivers to lock the extensions in place or release the extensions.

13. The apparatus of claim 12 wherein the extensions have upward facing detents for receiving the cams in selected positions.

14. The apparatus of claim 13 wherein the extensions extend rearward from ends of the second plate and wherein the receivers open forward to receive the extensions.

15. The method of adjusting a water ski binding comprising:

a toe portion movable relative to a ski and a fixed heel portion, sliding the toe portion rearward and moving rearward extensions on the toe portion into complementary tunnels in the heel portion and moving cams on the heel portion into upward facing detents on the rearward extensions to lock the toe portion in place.

* * * * *